US006675444B2

(12) United States Patent
Gruber

(10) Patent No.: US 6,675,444 B2
(45) Date of Patent: Jan. 13, 2004

(54) TOP COMB FOR A COMBING MACHINE

(75) Inventor: Peter Gruber, Georgensgmund (DE)

(73) Assignee: Staedtler & Uhl, Schwabach (DE)

( * ) Notice: Subject to any disclaimer, the term of this patent is extended or adjusted under 35 U.S.C. 154(b) by 0 days.

(21) Appl. No.: 10/204,210

(22) PCT Filed: Feb. 1, 2001

(86) PCT No.: PCT/EP01/01072

§ 371 (c)(1),
(2), (4) Date: Aug. 19, 2002

(87) PCT Pub. No.: WO01/61090

PCT Pub. Date: Aug. 23, 2001

(65) Prior Publication Data

US 2003/0019079 A1 Jan. 30, 2003

(30) Foreign Application Priority Data

Feb. 19, 2000 (DE) ..... 200 03 070 U

(51) Int. Cl.[7] ..... D01G 19/00
(52) U.S. Cl. ..... 19/215; 19/218; 19/221
(58) Field of Search ..... 19/114, 115 B, 19/115 R, 215, 218, 221, 129 R

(56) References Cited

U.S. PATENT DOCUMENTS 3,601,861 A * 8/1971 Moriwaki ..... 19/221
4,928,356 A * 5/1990 Egerer ..... 19/129 R
5,054,167 A 10/1991 Egerer
5,228,173 A * 7/1993 Egerer ..... 19/218
5,581,848 A * 12/1996 Egerer ..... 19/114

FOREIGN PATENT DOCUMENTS

| | | |
|---|---|---|
| EP | 0 351 443 A1 B1 | 1/1990 |
| EP | 0 427 974 A1 | 5/1991 |
| EP | 0 580 549 A1 | 1/1994 |

* cited by examiner

*Primary Examiner*—Gary L. Welch
(74) *Attorney, Agent, or Firm*—Browdy and Neimark, P.L.L.C.

(57) ABSTRACT

In a top comb for a combing machine, having at least one row of stamped needles that are arranged in a parallel side-by-side relation and enclosed between two cover plates with a free needle projection (8) being left free, wherein compressed air channels are formed between the cover plates and adjacent pairs of needles are provided, in order to increase the efficiency of the cleaning effect, that the needles (1,1',1") incorporate embossings such that the congruent embossings of adjacent needles form an air channel (9,9',9"), wherein the embossings taper in their widths towards the outlet area (outlet opening 11,11',11").

7 Claims, 5 Drawing Sheets

TOP COMB FOR A COMBING MACHINE

BACKGROUND OF THE INVENTION

1. Technical Field of the Invention

The present invention is directed to a top comb for a combing machine comprising at least one row of stamped needles that are arranged in a parallel side-by-side relation and enclosed between two cover plates with a free needle projection being left free, wherein compressed air channels are formed between the cover plates and adjacent pairs of needles. A top comb of this type is known from EP 0 351 443 C1.

2. Prior Art

During the combing process particles and fiber residue deposit on the free needle projection that interfere with the combing quality. To counter these deposits, mechanical cleaning devices were initially used. A significant improvement was attained with a pneumatic cleaning of the needle projection, as it is described in EP 0 351 443 C1.

OBJECT AND SUMMARY OF THE INVENTION

With this as the starting point, the invention is based on the object of further increasing the effectiveness of the cleaning effect in a pneumatically cleaned top comb of the above type.

This object is met according to the invention in such a way that the needles have embossings such that the congruent embossings of adjacent needles form an air channel and the embossings narrow in their widths toward the outlet area.

Due to this narrowing and, hence, reduction in cross section, an increase is attained in the flow velocity of the exiting airflow, so that the same can be used even more effectively for cleaning. Furthermore, the airflow can also be directed even more specifically toward those sections of the free needle projection where particularly heavy impurities are deposited.

In a further design of the invention, provision is made for at least one cover plate to have a free projection in the outlet area and to be bent inward under formation of an air conducting zone. This supports the targeted guiding of the airflow.

Provision may furthermore advantageously be made for the embossings in the needles to extend into the region of the free needle projection. This provides for a certain guiding of the airflow even after it has left the zone that is covered by the cover plates.

The cover plates advantageously project beyond the needles at their top sides and an air supply channel and/or an air distribution channel is formed in this region by means of a deep-drawing of the cover plates. In this manner, the compressed air coming from a compressed air source can be distributed to the channels that are formed between the individual needles.

Lastly, provision may be made for an airflow divider to be formed in the air channel. This creates two partial airflows that can be directed specifically, for example, toward the front edge and the rear edge of the needle.

BRIEF DESCRIPTION OF THE DRAWINGS

The invention will be described in more detail below based on preferred embodiments in conjunction with the drawing.

DETAILED DESCRIPTION OF THE PREFERRED EMBODIMENT OF THE INVENTION

Figure 1:
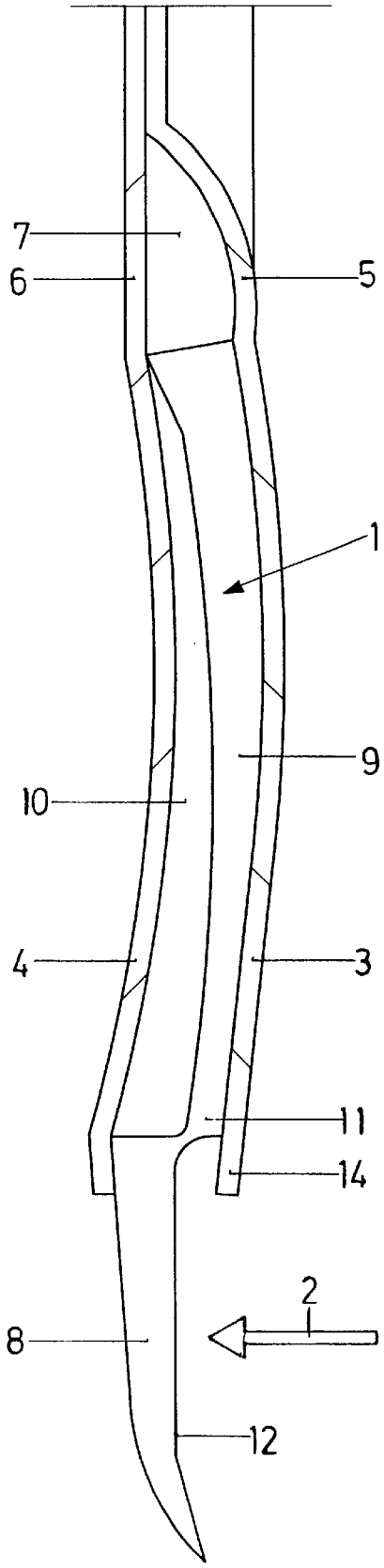
FIGS. 1 through 3 show different embodiments for the configuration of the air channels in an inventive top comb.

A top comb shown in FIG. 1 comprises a row of needles 1 that are disposed side by side, which are covered by a front and rear cover plate 3 and 4 relative to the direction of movement (arrow 2) of the sliver. The front cover plate 3 and the rear cover plate 4 each have top ends that projects beyond the needles. A convexity 5 produced by deep-drawing, which, together with the projecting portion 6 of the rear cover plate 4, forms an air distribution channel 7.

The needles 1, in the region of their free needle projection 8, are tapered in their thickness and sharpened by means of embossing. An air conducting channel or depressions 9 which can also be formed by embossing, which is delimited on its one side by the front cover plate 3 and on its other side by the non-depressed sections 10 of two given adjacent needles 1. The air channel 9 tapers towards the outlet opening 11, which accelerates the air flow and specifically directs the same to the front edge 12 of the needle 1, viewed in the combing direction.

Figure 2:
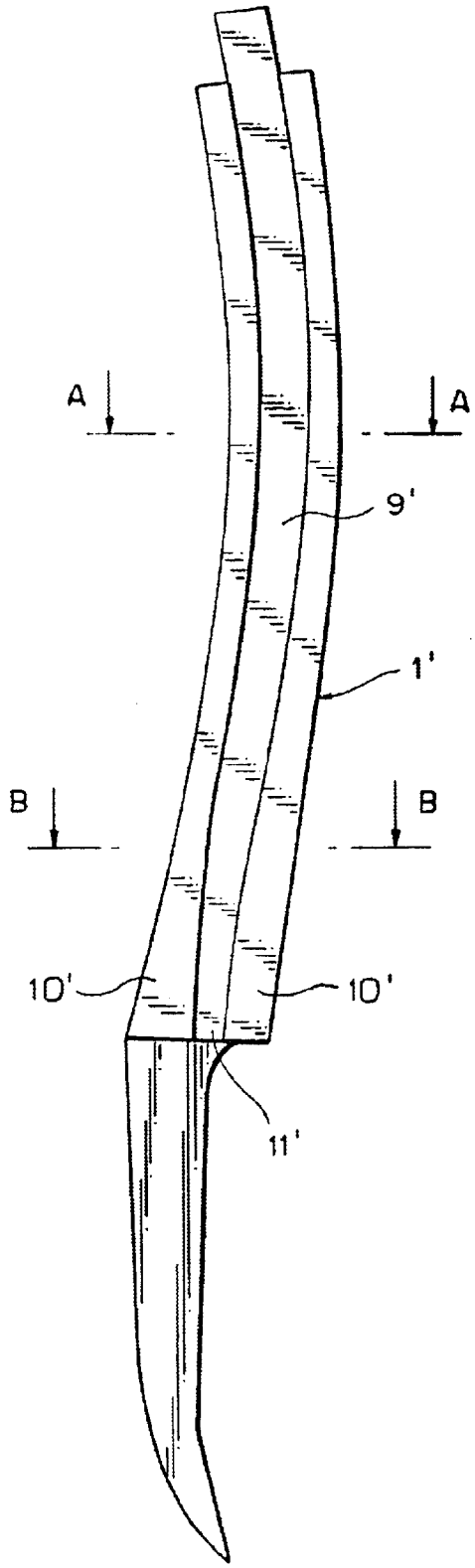
Figure 6:
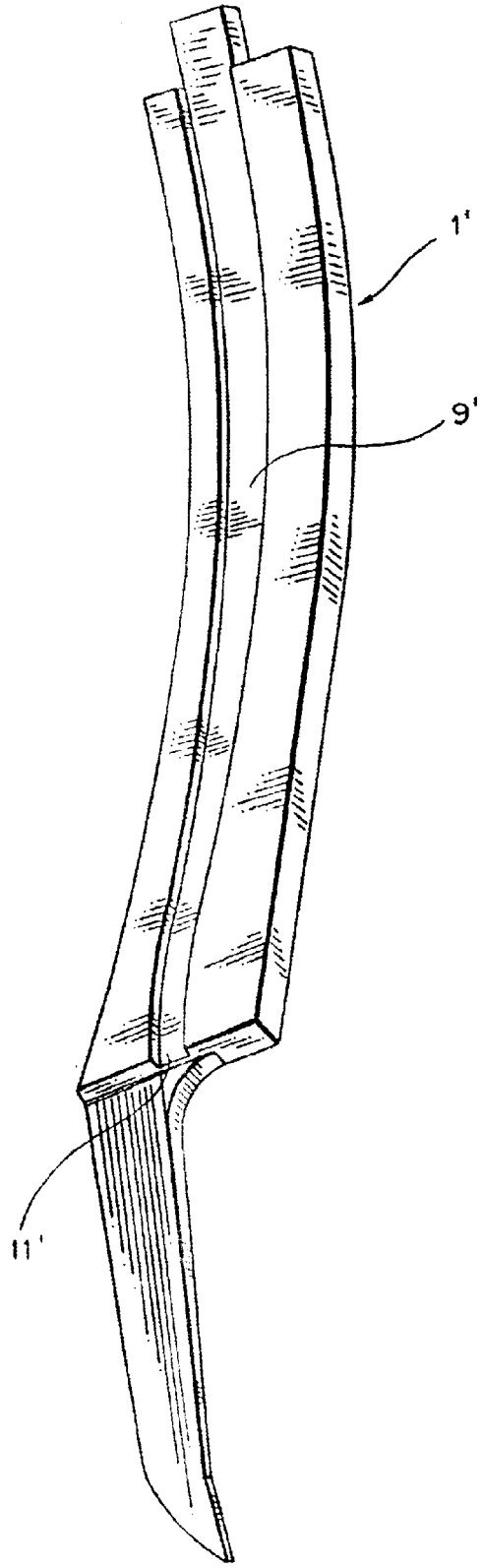
FIG. 6 shows a perspective view of a single needle of the top comb of FIG. 2.

FIGS. 2 and 6 shows a needle 1', in which the air channel (depression) 9' is delimited by two non-depressed areas 10' and outlet opening 11'.

Figure 4:
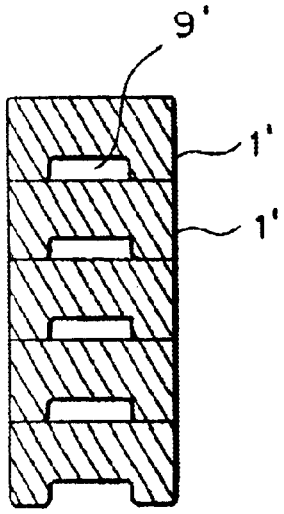
FIG. 4 shows a cross-section through the top comb along sectional line 4—4 of FIG. 2.
Figure 5:
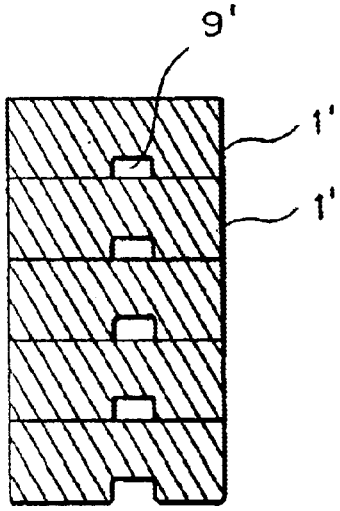
FIG. 5 shows a cross-section through the top comb along section line 5—5 of FIG. 2

FIGS. 4 and 5 show cross-sections through needle 1' illustrating the tamper of the width of the depression towards outlet opening 11' and the closing of air channel 9' by the outer side of an adjacent needle 1'.

Figure 3:
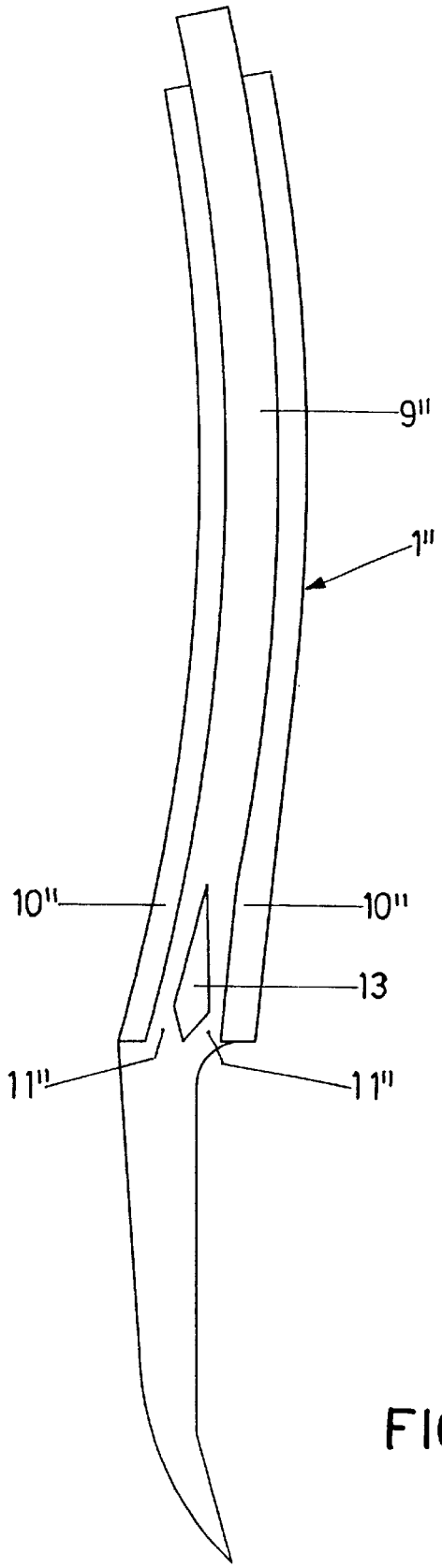

FIG. 3 shows a needle 1" wherein the air channel (depression) 9" is delimited by two non-depressed areas 10", wherein additionally, however, an airflow divider 13 is provided in the form of a non-depressed section whereby the airflow in the air channel 9" is divided and routed to two separate outlet openings 11".

In the embodiments according to FIGS. 2 and 3, the cover plates are not shown in the drawings. Regarding the front cover plate 3, provision may be made for the same to have a free projection 14, which may be bent inward compared to the illustration in FIG. 1 under formation of an air conducting zone, so that the air is directed to the front edge 12 of the free needle projection 8 in an even more targeted manner.

What is claimed is:

1. A top comb for a combing machine, comprising at least one row of stamped needles that are arranged in a parallel side-by-side relation and enclosed between two cover plates with a free needle projection being left free, wherein compressed air channels are formed between the cover plates and adjacent pairs of needles, wherein the needles (1, 1', 1") incorporate depressed sections such that the congruent depressed sections of adjacent needles form an air channel (9, 9', 9") which is closed between an inlet and an outlet respectively at opposite ends of the air channel, the depressed sections tapering in their widths towards the outlet (11, 11', 11").

2. A top comb according to claim 1, wherein at least one cover plate (3) in the outlet area has a free projection (14) and is bent inward under formation of an air conducting zone.

3. A top comb according to claim 1, wherein the depressed sections in the needles (1) extend into the region of the free needle projection (8).

4. A top comb according to claim 1, wherein the cover plates (3, 4) project beyond the needles (1) at their top ends and wherein an air supply channel and an air distribution channel (7) are formed in this area by means of a deep-drawing of the cover plates (3, 4).

5. A top comb according to claim 1, wherein an air distributor (13) is formed in the air channel (9").

6. A top comb according to claim 1, wherein the depth of the cutout sections decreases towards the outlet.

7. A top comb according to claim 1, wherein the depressed sections are formed by embossing.

* * * * *